US011827017B2

(12) United States Patent
Hashimoto et al.

(10) Patent No.: US 11,827,017 B2
(45) Date of Patent: Nov. 28, 2023

(54) LIQUID CARTRIDGE

(71) Applicant: CANON KABUSHIKI KAISHA, Tokyo (JP)

(72) Inventors: Yusuke Hashimoto, Kanagawa (JP); Junichiro Iri, Kanagawa (JP); Hiroaki Kusano, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 16 days.

(21) Appl. No.: 17/540,040

(22) Filed: Dec. 1, 2021

(65) Prior Publication Data

US 2022/0184951 A1 Jun. 16, 2022

(30) Foreign Application Priority Data

Dec. 10, 2020 (JP) ..... 2020-205129

(51) Int. Cl.
*B41J 2/14* (2006.01)

(52) U.S. Cl.
CPC .. *B41J 2/14072* (2013.01); *B41J 2002/14491* (2013.01); *B41J 2202/18* (2013.01)

(58) Field of Classification Search
CPC ..... B41J 2/14072; B41J 2002/14491; B41J 2202/18
See application file for complete search history.

(56) References Cited

U.S. PATENT DOCUMENTS 8,511,798 B2 * 8/2013 Ito ..... B41J 2/14233 29/25.35

FOREIGN PATENT DOCUMENTS

JP 2009000905 A 1/2009

* cited by examiner

*Primary Examiner* — Geoffrey S Mruk
(74) *Attorney, Agent, or Firm* — Canon U.S.A., Inc. I.P. Division

(57) ABSTRACT

A liquid ejection head includes a recording element substrate. The recording element substrate includes a recording element, a circuit wiring driving the recording element to eject liquid, a protective film, an electrode area, a plating bump, and a resin film having elastic properties. The electrode area electrically connects the circuit wiring to an external circuit through an opening in the protective film. The protective film covers the circuit wiring in an outer adjacent region to the opening to define a step in the protective film. The protective film protects the circuit wiring against the liquid. The plating bump is electrically connected to the electrode area. The resin film covers the step and extends from an inner peripheral region of the opening onto the protective film beyond an edge of the opening. The plating bump includes a part projecting from the electrode area onto an upper surface of the resin film.

7 Claims, 8 Drawing Sheets

FIG. 9AA
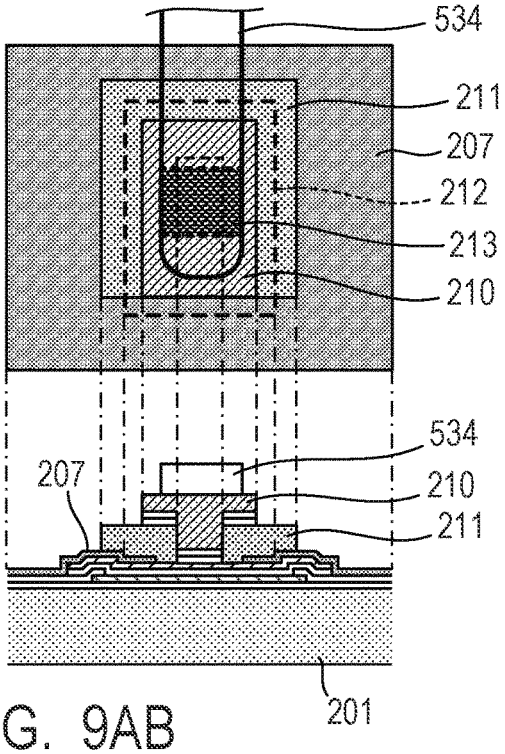
FIG. 9AB
FIG. 9BA
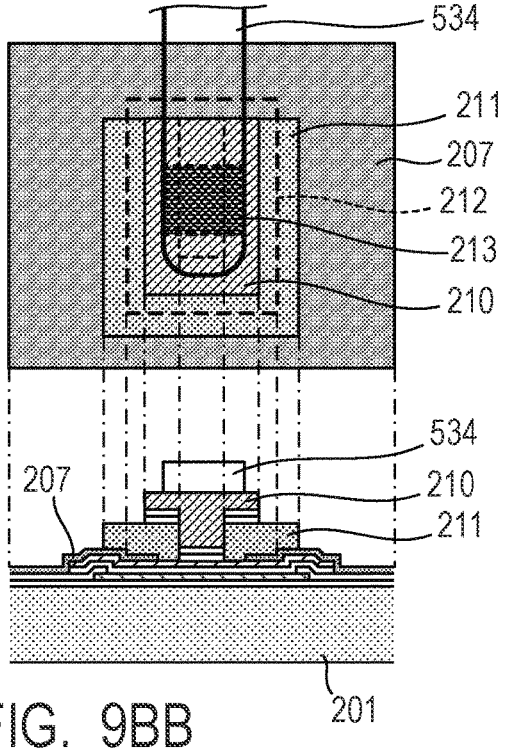
FIG. 9BB
FIG. 9CA
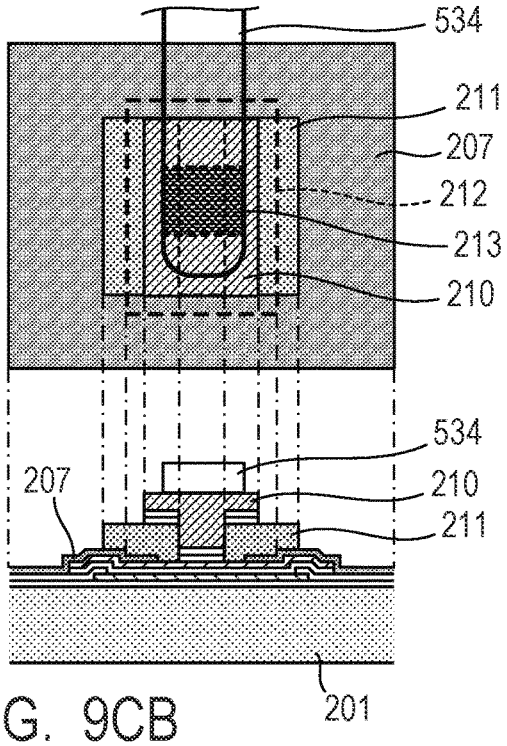
FIG. 9CB

LIQUID CARTRIDGE

BACKGROUND

Field

The present disclosure relates to a liquid ejection head and a method of manufacturing the same.

Description of the Related Art

Liquid ejection heads are known as means for ejecting liquid from an ejection orifice by applying energy to the liquid to be ejected by means of a recording element. Such a liquid ejection head comprises a recording element substrate, on which recording elements, circuit wiring for driving the recording elements, electrode terminals electrically connected to the circuit wiring and other components are formed. The electrode terminals are provided, for example, as so many bumps and the electric connection between any external circuit and the liquid ejection head is realized by electrically connecting the electrode terminals and the electrode leads of the electrical wiring tape extending from the external circuit. In recent years, plating bumps that are formed by growing gold by means of electroplating are employed as bumps that operate as electrode terminals. Japanese Patent Application Laid-Open No. 2009-000905 discloses a gang bonding method for arranging a plurality of plating bumps on a recording element substrate and then collectively connecting the flying leads of an electrode wiring tape to those plating bumps by means of thermocompression bonding.

When connecting an electrode lead to a plating bump by means of thermocompression bonding, a load is applied to the plating bump. Then, the load can adversely affect the protective film to consequently break or otherwise damage the protective film. If the protective film is damaged, one or more circuits and wirings arranged on the recording element substrate can be corroded by the liquid to be ejected from the liquid ejection head.

SUMMARY

Disclosed herein is a liquid ejection head whose electric connections are realized by means of plating bumps that can minimize the damage given to the protective film at the time of compression bonding of electrode leads to the plating bumps of the liquid ejection head and also to a method of manufacturing such a liquid ejection head.

According to an aspect of the present disclosure, a liquid ejection head includes a recording element substrate, wherein the recording element substrate includes a recording element to be driven to eject liquid, a circuit wiring for supplying energy for driving the recording element, a protective film for covering the circuit wiring to protect the circuit wiring against the liquid, an electrode area exposed through an opening arranged in the protective film to electrically connect the circuit wiring to an external circuit, wherein the protective film covers the circuit wiring in an outer adjacent region to the opening to define a step in the protective film, a plating bump made of a metal material and arranged on the electrode area so as to be electrically connected to the electrode area, and a resin film that has elastic properties and is formed to cover the step and to extend from an inner peripheral region of the opening onto the protective film beyond an edge of the opening, wherein the plating bump includes a part projecting from a top of the electrode area onto an upper surface of the resin film.

Further features of the present disclosure will become apparent from the following description of exemplary embodiments with reference to the attached drawings.

BRIEF DESCRIPTION OF THE DRAWINGS

FIGS. 9AA, 9AB, 9BA, 9BB, 9CA and 9CB are views illustrating exemplary resin film forming regions.

DESCRIPTION OF THE EMBODIMENTS

First Embodiment

Figure 1:
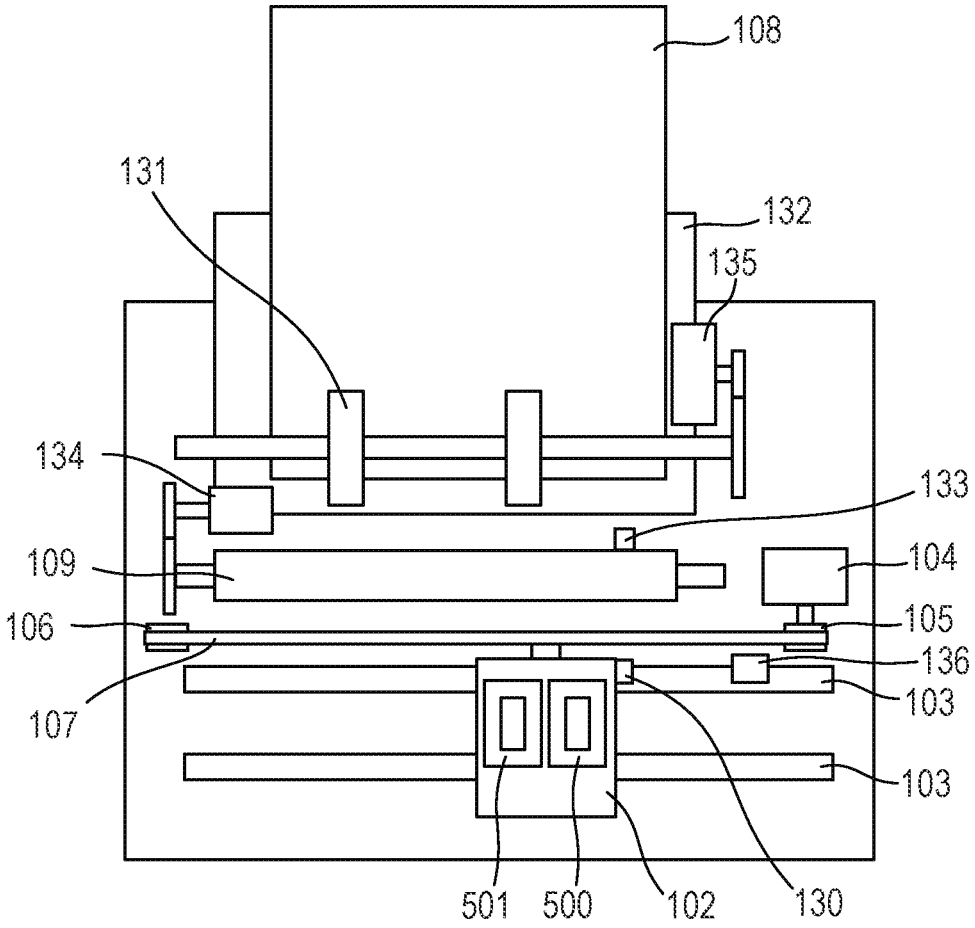
FIG. 1 is a schematic plan view of a liquid ejection head.

Now, some of the currently preferable embodiments of the present disclosure will be described below by referring to the accompanying drawings. The present disclosure relates to a liquid ejection head and a method of manufacturing the same. However, for ease of understanding the present disclosure, a liquid ejection apparatus in which such a liquid ejection head is mounted will be described first. FIG. 1 is a schematic plan view of an exemplary liquid ejection apparatus, illustrating the configuration thereof.

The liquid ejection apparatus shown in FIG. 1 is designed to perform a recording operation by ejecting liquid, which may typically be ink, onto a recording medium 108 such as a sheet of paper or a plastic material. The liquid ejection apparatus comprises liquid ejection heads 500 and 501 and a carriage 102 carrying the liquid ejection heads 500 and 501 at their respective right positions so as to allow them to be replaceable. The carriage 102 is provided with an electric connection area that operates to transmit driving electric signals to the parts of the liquid ejection heads 501 and 502 that operate for liquid ejection by way of connection terminals 532 for external signals (see FIG. 2A) arranged in the liquid ejection heads 500 and 501. The carriage 102 is supported by a guide shaft 103 that is arranged in the apparatus main body so as to run in the main scanning direction (in the transversal direction in FIG. 1). In other words, the carriage 102 can move back and forth along the guide shaft 103. Additionally, the carriage 102 is driven to move by means of a main scanning motor (carriage motor) 104 and by way of a transmission mechanism that includes a motor pulley 105, a driven pulley 106 and a timing belt 107. The position of the carriage 102 and its move are also controlled by the transmission mechanism. The carriage 102 is also provided with a home position sensor 130. A position that is to be defined as the home position of the carriage 102 is detected and determined when the home position sensor 130 passes by the shield plate 136 arranged in the apparatus main body.

Recording mediums 108 are placed on the sheet feeder tray 132 of the auto-sheet feeder (ASF) of the apparatus and, as the sheet feeding motor 135 drives the pickup roller 131 to rotate by way of gears by a given angle, a recording medium 108, which may typically be a sheet of paper and placed on top of the recording mediums 108, is picked up and separated from the rest of the recording mediums 108 on the sheet feeder tray 132 and fed to the recording position. Additionally, as the conveyor roller 109 is driven to rotate by a conveyor motor 134 and by way of gears, the picked up recording medium 108 is conveyed (in the subscanning direction) by way of the position (recording region) located vis-a-vis the surface (the ejection orifice surface) where the ejection orifices of the ejection heads 500 and 501 are formed. In the sheet feeding operation, if the recording medium 108 is properly fed or not is judged and the front edge position of the recording medium 108 is detected and determined when the recording medium 108 passes by a sheet end sensor 133. The sheet end sensor 133 is also operated to detect the actual position of the rear edge of the recording medium 108 and ultimately determine the current recording position from the actual position of the rear end of the recording medium 108. Note that the rear surface of the recording medium 108 is supported on a platen (not shown) so as to produce a flat recording surface in the recording region of the recording apparatus. Then, the liquid ejection heads 500 and 501 that are mounted on the carriage 102 are held such that the plane defined by the ejection orifices of the liquid ejection heads 500 and 501 is in parallel with the recording medium 108 and projects downward from the carriage 102 so as to allow the recording region to be scanned in the main scanning direction.

The liquid ejection heads 500 and 501 are mounted on the carriage 102 such that the direction in which the ejection orifices of their respective liquid ejecting sections are arranged in rows intersects the main scanning direction of the carriage 102 (e.g., in the subscanning direction). As ink is ejected from the ejection orifices that are arranged in rows in the process of a main scanning operation, a recording operation that extends over a width that corresponds to the range of arrangement of the ejection orifices will be executed. In the instance illustrated in FIG. 1, the liquid ejection heads 500 and 501 are integrally combined with their respective ink tank or ink tanks. More specifically, the liquid ejection head 500 is equipped with an ink storage section that is filled with black ink and an ejection section that ejects the black ink supplied from the ink storage section. On the other hand, the liquid ejection head 501 is equipped with three ink storage sections respectively filled with inks of three different colors (cyan, magenta and yellow) and three ejection sections that eject the inks of the three different colors supplied from the ink storage sections. The liquid ejection heads 500 and 501 are rigidly supported on the carriage 102 and secured in position by their respective positioning means and electric contacts. Additionally, the liquid ejection heads 500 and 501 are provided in the form of so many cartridges that are removably fitted to the carriage 102. Thus, when the ink filled and stored in the liquid ejection head 500 is totally consumed, it can be replaced by a new one. Similarly, when one of the inks filled and stored in the liquid ejection heads 500 and 501 is totally consumed, the liquid ejection head 500 or 501 in question can be taken out and replaced by a new one.

Figure 2A:
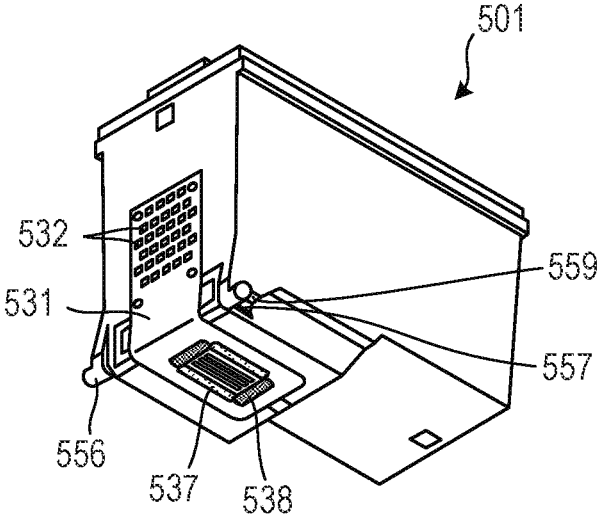
FIGS. 2A and 2B are schematic perspective views of a liquid ejection head, showing an exemplary configuration thereof.
Figure 2B:
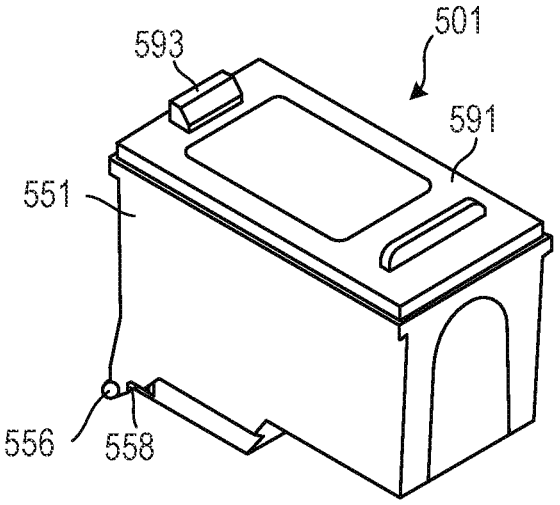
Figure 3A:
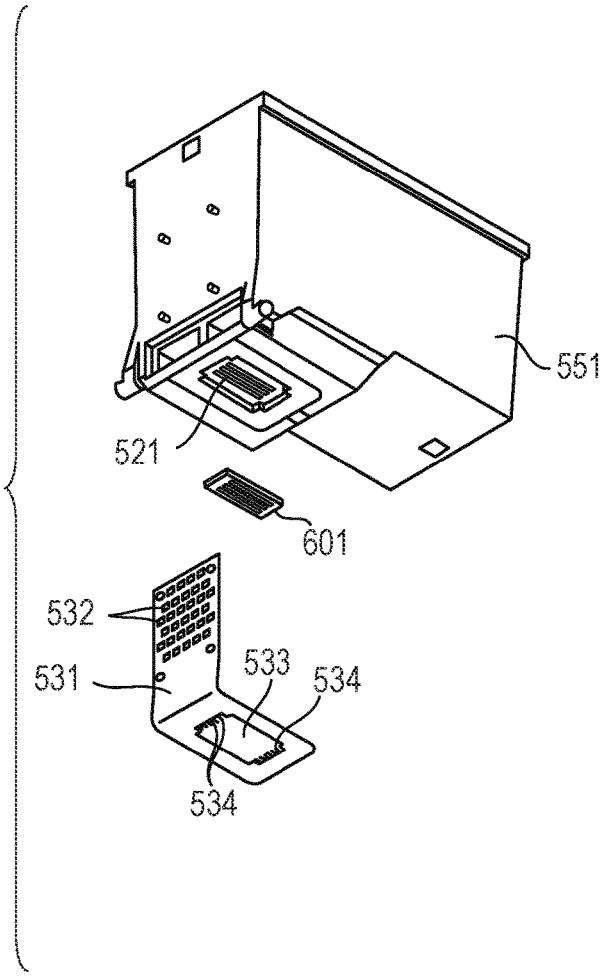
FIGS. 3A and 3B are exploded schematic perspective views of the liquid ejection head shown in FIGS. 2A and 2B.
Figure 3B:
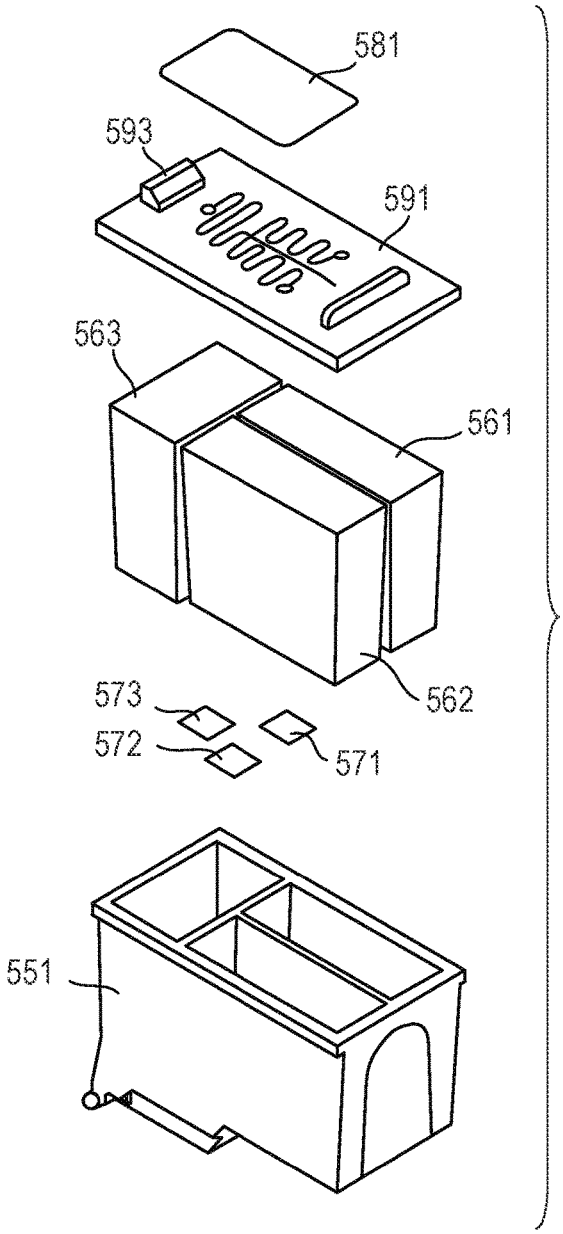

Now, the basic configuration of one of the liquid ejection heads 500 and 501, or the liquid ejection heads 501 for color inks, will be described below by referring to FIGS. 2A and 2B to FIG. 4. Since the configuration of the liquid ejection head 500 for black ink is the same as, and identical with, that of the liquid ejection head 501 except that the former is for ink of a single color, or for black ink, it will not be described any further. FIGS. 2A and 2B are schematic perspective views of the liquid ejection head 501 that can be mounted in the liquid ejection apparatus illustrated in FIG. 1, showing its exemplary configuration. FIGS. 3A and 3B are exploded schematic perspective views of the liquid ejection head 501. FIGS. 2A and 3A are views of the liquid ejection head 501 as viewed from its ejection orifice surface side and FIGS. 2B and 3B are views of the liquid ejection head 501 as viewed from the side opposite to the ejection orifice surface side. As shown in FIGS. 2A and 2B, the liquid ejection head 501 is mounted on and rigidly secured to the cartridge 102 as a mounting guide 556 for guiding the liquid ejection head 501 to its proper mounting position on the cartridge 102 is brought into engagement with the fixing lever (not shown) arranged on the cartridge side. The liquid ejection head 501 is provided with an engagement section 593 for rigidly fixing the liquid ejection head 501 to the cartridge 102 and also with abutting sections 557, 558 and 559 for making the liquid ejection head 501 abut them respectively in the X direction (in the main scanning direction), in the Y direction (in the subscanning direction) and in the Z direction (in the vertical direction) for the purpose of placing the liquid ejection head 501 at the predetermined right position. As the liquid ejection head 501 is placed at the predetermined right position on the cartridge 102 by means of the abutting sections 557, 558 and 559, the connection terminal 532 on the electric wiring tape 531 is allowed to electrically contact the contact pins of the electric connection area arranged in the cartridge 102.

As shown in FIGS. 3A and 3B, in the liquid ejection head 501, a recording element substrate 601 and an electrical wiring tape 531 are fitted to the main body member 551, which is a supporting member of the liquid ejection head 501. Since the liquid ejection head 501 is a tank-integrated type head, it has three cavities in the inside of the main body member 551 that operate as so many ink storage sections. These cavities respectively contain ink absorbers 561, 562 and 563 in them. Three filter members 571, 572 and 573 are arranged at respective positions of the three cavities that provide their ink outlet ports. The main body member 551 is closed by a lid member 591 having an engagement section 593 formed on it. A seal member 581 is arranged on the front surface of the lid member 591 in order to prevent the liquid stored in the cavities from leaking out to the outside by way of the air communication port formed on the lid member 591. The main body member 551 is provided on the lower surface thereof with a recess for receiving a recording element substrate 601 and ink supply ports 521 that are respectively held in communication with the ink storage sections are formed in the recess. As will be described hereinafter, a window 533 and an electrode lead 534 are arranged on the electrical wiring tape 531.

Figure 4:
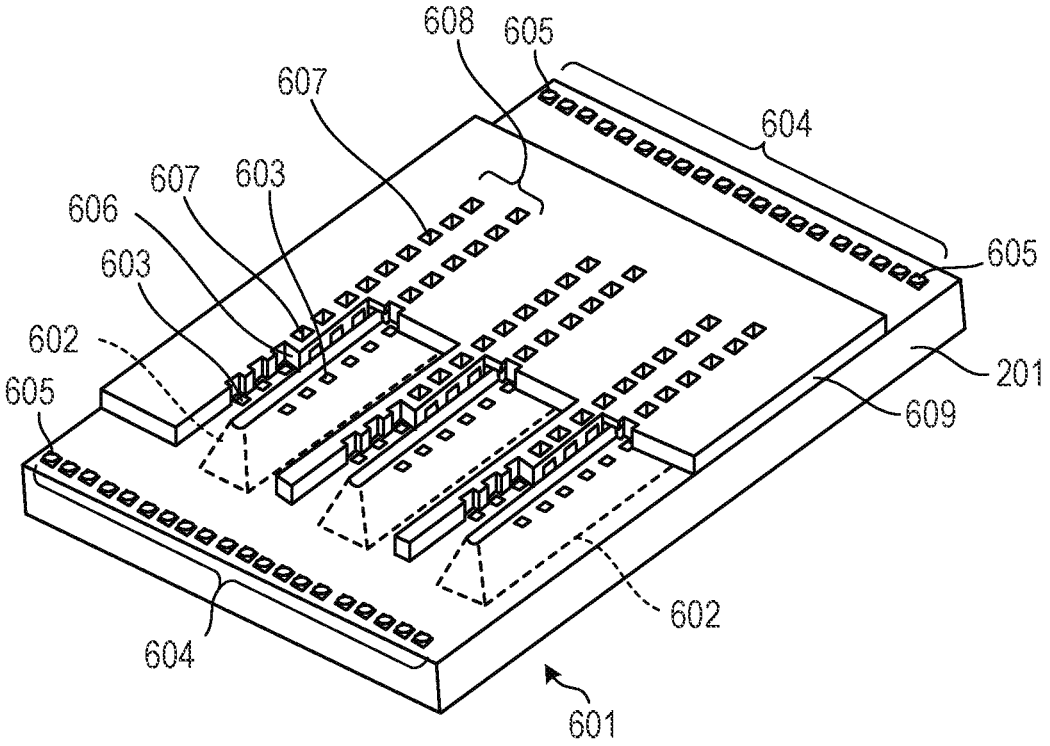
FIG. 4 is a partly cutaway schematic perspective view of a recording element substrate.

FIG. 4 is a partly cutaway perspective view of the recording element substrate 601 to be used for the liquid ejection head 501 for color inks, illustrating the configuration thereof. The recording element substrate 601 shown there is formed by using electrothermal transducers, each of which generates thermal energy as a function of the electric signal applied to it, as recording elements for generating energy necessary for ejecting ink from the corresponding respective ejection orifices. In the liquid ejection head 501, the electrothermal transducers and the corresponding respective ejection orifices are arranged vis-a-vis and ink is ejected in the direction perpendicular to the main surface of the recording element substrate (and such a liquid ejection head is referred to as of the side shooter type).

In the recording element substrate 601 shown in FIG. 4, three oblong ink supply ports 602 are arranged side by side so as to extend in parallel with each other and run through the silicon substrate 201 as so many through-holes. The three oblong ink supply ports 602 are for cyan ink, magenta ink and yellow ink. Each of the three rows of ink supply ports 602 is sandwiched between two rows of electrothermal transducers 603 that extend in the subscanning direction. Each of the electrothermal transducers 603 generates thermal energy necessary for giving rise to film boiling in ink as a function of the electric signal applied to it. Each of the electrothermal transducers 603 of any selected one of the rows of electrothermal transducers 603 is shifted by a ½ pitch from the corresponding one of electrothermal transducers of the corresponding one of the rows of electrothermal transducers 603 arranged oppositely relative to the selected row of electrothermal transducers 603 with one of the ink supply ports 602 sandwiched between them. Additionally, an ejection orifice forming member 609, in which flow path walls 606 and ejection orifices 607 are formed by means of the photolithography technology, is bonded onto the recording element substrate 601 with each of the electrothermal transducers 603 aligned with the corresponding one of the ejection orifices 607. Thus, the ejection section 608 of each of the color inks of cyan, magenta or yellow is formed by the recording element substrate 601 and the ejection orifice forming member 609.

Electrical wiring for supplying electric power to the electrothermal transducers 603, a fuse and a drive circuit for driving the electrothermal transducers 603 are formed on the silicon substrate 201 in addition to the electrothermal transducers 603 and, furthermore, electrode areas 604 for electrically connecting the above-listed members to one or more than one external circuit are also formed on the silicon substrate 201. The external circuit or circuits as mentioned above may be any circuit or circuits arranged outside and separated from the liquid ejection head 501. Such external circuits may include a control circuit and a power supply circuit arranged in the main body of the liquid ejection apparatus. Electrode terminals 605 are formed in the electrode areas 604 as so many plating bumps of gold (Au) or the like. The present disclosure also relates to an electrode terminal 605 formed as a plating bump. The electrothermal transducers 603, the electrical wiring for them and the drive circuit for them can be formed by means of the known film forming technologies that are based on the known semiconductor device manufacturing technologies.

The electrical wiring tape 531, which is an electrical wiring member, is designed to form an electric signal path to be used for electric signals that are to be applied to the recording element substrate 601 for the purpose of ink ejections. A window 533 for receiving the recording element substrate 601 is formed on the electrical wiring tape 531 and a pair of electrode leads 534 are formed at oppositely disposed edges of the window 533 so as to project from the edges. The electrode leads 534 are connected to the electrode areas 604 of the recording element substrate 601. Additionally, the above-described connection terminals 532 for receiving electric signals from the main body part of the liquid ejection apparatus are also formed on the electrical wiring tape 531 and the electrode leads 534 and the connection terminals 532 are connected to each other by way of an electroconductive wiring pattern that contains continuous copper foil. In the illustrated instance, the electrical wiring tape 531 is formed by using a TAB (tape automated bonding) tape, while the electrode leads 534 are formed as exposed flying leads. The electrical wiring tape 531 and the recording element substrate 601 are electrically connected to each other as the plating bumps on the electrode areas 604 of the recording element substrate 601, which are so many electrode terminals 605, are respectively bonded to the electrode leads 534, which correspond to the electrode terminals 605 by means of the gang bonding type bonding technique.

Figure 5:
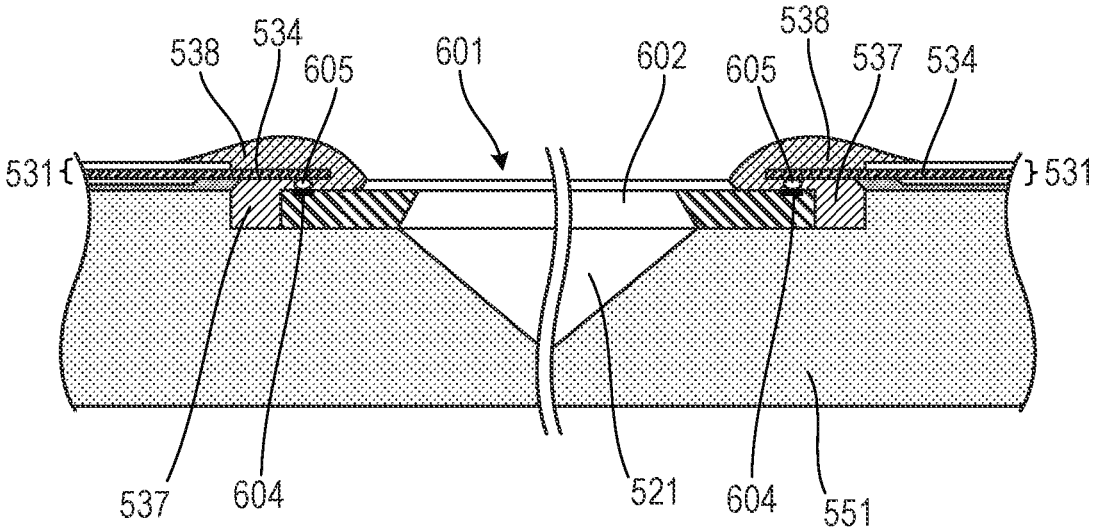
FIG. 5 is a schematic cross-sectional view of a part of the electric connection area, showing how it is shielded.

FIG. 5 is an enlarged schematic view of the electric connection area of the recording element substrate 601 and the electrical wiring tape 531. Both the recording element substrate 601 and the electrical wiring tape 531 are fitted to the main body member 551. The electric connection areas of the recording element substrate 601 and the electrical wiring tape 531 are sealed by the first sealing agent 537 and the second sealing agent 358 and, as a result, the electric connection areas are protected against corrosions caused by moisture such as ink and external impacts. The first sealing agent 537 mainly seals the connection areas of the electrode leads 534 of the electrical wiring tape 531 and the electrode terminals 605 of the recording element substrate 601 at the rear surface side of the connection areas, which is the side of the main body member 551 and an outer peripheral portion of the recording element substrate 601. The second sealing agent 538 is applied after the application of the first sealing agent 537. It mainly seals the connection areas of the electrode leads 534 and the electrode terminals 605 at the front surface side of the connection areas, namely the side opposite to the side of the main body member 551 as viewed from the electrode leads 534.

Figure 6A:
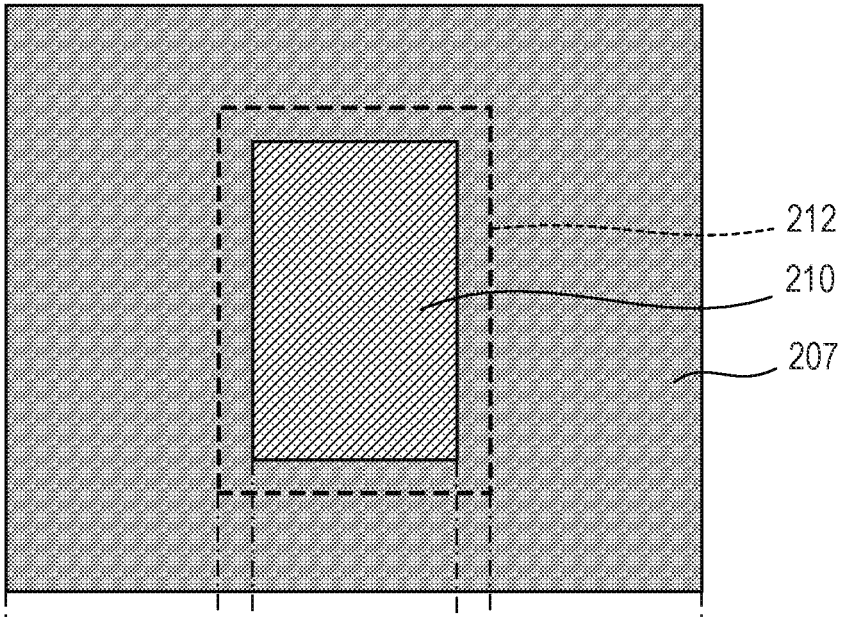
FIGS. 6A and 6B are a schematic illustration of a known plating bump.
Figure 6B:
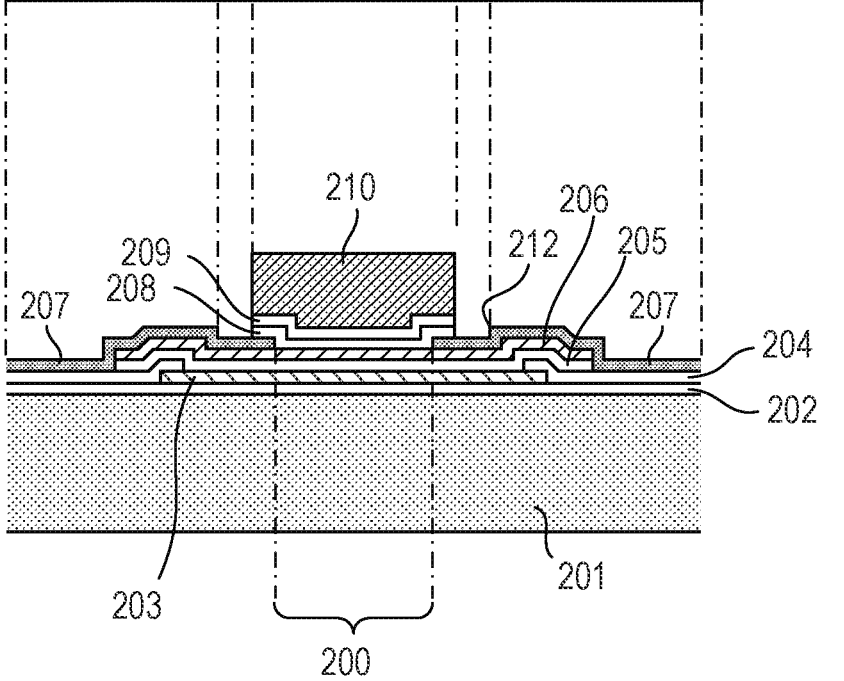

Ordinary plating bumps that are being popularly employed as electrode terminals 605 on the recording embodiment substrate 601 of any of the liquid ejection heads of liquid ejection apparatus having the above-described configuration will be described below by referring to FIGS. 6A and 6B. FIG. 6A is a schematic plan view of a part of the recording element substrate 601 of a liquid ejection head where a plating bump is formed and FIG. 6B is a schematic cross-sectional view of the part of the recording element substrate 601 shown in FIG. 6A. As shown in FIGS. 6A and 6B, in the recording element substrate 601, a heat storage layer 202 of $SiO_2$ is formed on the entire area of one of the opposite surfaces of the silicon substrate 201 and the patterned first electrical wiring film 203 of aluminum is arranged on the heat storage layer 202. An SiO-made interlayer insulating film 204 is formed to cover the entire peripheral edges of the first electrical wiring film 203. The interlayer insulating film 204 may alternatively be formed on the heat storage layer 202 so as to entirely cover the heat storage layer 202 including the first electrical wiring film 203. A patterned heating film 205 that is made of an electroconductive material is arranged on the interlayer installation film 204. Additionally, the patterned second electrical wiring film 206 of aluminum is arranged so as to cover the heating film 205. While the heating film 205 and the second electrical wiring film 206 are held in direct contact, there is an area not shown in FIGS. 6A and 6B where the second electrical wiring film 206 is not held in contact with the heating film 205 and this area operates as electrothermal transducer. While the heating film 205 and the electrical wiring films 203 and 206 operate at least as part of the circuit wiring of the liquid ejection head 501, a protective film 207 is formed on one of the uppermost surfaces of the recording element substrate 601 in order to protect the circuit wiring. The protective film 207 is typically made of SiC, SiN or some other similar material and the above-listed these materials are characterized as hard and brittle materials. Additionally, since the heating film 205 and the electrical wiring films 203 and 206 that are arranged on the recording element substrate 601 are subjected to a patterning operation, steps are produced on one of the opposite surfaces of the recording element substrate 601. Accordingly, steps, such as a step having a shape that includes a rise and run suggestive of a step shape in a staircase, are also produced on the protective film 207. Thus, the protective film 207 is bent in the thickness direction thereof and the step denoted by reference numeral 212 in FIGS. 6A and 6B and other related drawings is a step adjacent to the electrode area 604 (namely the through-hole 200) so as to surround one of the electrode areas 604.

Openings are produced on the protective film 207 at the positions where the plating bumps are formed and the second electrical wiring film 206 is exposed at each of those positions. In other words, through-holes 200 are formed through the protective film 207. The through-holes 200 can be produced by patterning the protective film 207 by means of the photolithography technology. The areas of the second electrical wiring film 206 that are exposed as a result of forming the through-holes 200 operate as so many electrode areas 604 described above by referring to FIGS. 4 and 5. In the through-holes 200, a thin adhesion improvement layer 208, which is made of a high melting point metal material such as TiW, is formed on the second electrical wiring film 206 and a gold layer 209 that operates as plating base layer, which is to be employed as an electrode in the electroplating process, is arranged on the adhesion improvement layer 208. A thick plating bump layer 210 is formed on the gold layer 209 by means of electroplating of gold to produce plating bumps that operates as so many electrode terminals 605. The adhesion improvement layer 208 is held in tight contact with the entire exposed area of the second electrical wiring layer 206 in each of the through-holes 200 and also held in tight contact with the surrounding protective film 207 beyond the edge of the through-hole 200. For the purpose of realizing such an arrangement, the plating bump layer 210 is formed so as to be slightly greater than the through-hole 200 and the outer peripheral area of the plating bump layer 210 is arranged so as to extend onto the part of the protective layer 207 that operates as the edge of the through-hole 200 by way of the adhesion improvement layer 208 and the gold layer 209. In the process of preparing these plating bumps, after forming the through-holes 200, the adhesion improvement layer 208 and the gold layer 209 are formed on the entire surface of the recording element substrate and, additionally, negative type photoresist is applied onto it. Then, the applied photoresist is subjected to a patterning operation such that the openings are produced at the positions where the plating bump layer 210 is formed. Thereafter, the plating bump layer 210 is made to grow thick at the positions where the openings are formed on the photoresist by means of electroplating of gold, using the gold layer 209, which is the plating base layer, as cathode electrode. Subsequently, the photoresist is removed and the unnecessary parts of the gold layer 209 and those of the adhesion improvement layer 208 are removed by means of etching to complete thy operation of producing the plating bumps. A plurality of plating bumps are formed at regular intervals on the recording element substrate 601 in one row and the electrode leads 634 (flying leads) of electrode wiring tapes are collectively connected to these plating bumps by means of thermocompression bonding.

For the purpose of avoiding any defective connection between the plating bumps and the electrode leads 534, it may conceivably necessary to control the temperature of the bonding tool during the thermocompression bonding operation and raise both the impact load and the pressing load of the bonding tool. The impact load is the load that is applied as impact at the time when the bonding tool is made to abut the plating bumps by way of the electrode leads 534, whereas the pressing load is the load that is applied to the plating bumps when the bonding tool keeps on pressing the plating bumps by way of the electrode leads 534 after the abutment. However, the steps of the protective film 207 can sometimes be damaged to give rise to one or more than one crack at positions located outside the edges of the plating bumps when the bonding tool applies pressure (both an impact load and a pressing load) to the bonding bumps by way of the electrode leads. Particularly, such a crack or cracks can easily appear at the step 212 that is arranged at a position located adjacent to the through-hole 200 so as to surround the through-hole 200. Now, the process where the protective film 207 is damaged to give rise to a crack or cracks will be described below.

As the bonding tool exerts power to the plating bumps by applying pressure to the latter by way of the electrode leads 534, both the electrode leads 534 and the plating bumps will be crushed. Additionally, the first and second electrical wiring films 203 and 206 that are formed as circuit wiring under the plating bump at the position located right under the electrode lead 534 will also be crushed because they are made of aluminum. To the contrary, the heat storage layer 202 and the silicon substrate 201 that are formed underside relative to the first electrical wiring film 203 are made of respective materials that are harder than aluminum and hence will not be crushed by the pressure applied by the bonding tool. The plating bumps and the electrical wiring films 203 and 206 that are crushed by the pressure applied from the bonding tool will be moved to the outside of the area where the crush takes place so as to move away from the position of the through-hole 200. The parts of the protective film 207 that is located at the underside of the plating bumps are also moved to follow the moving films because they are respectively held in tight contact with the plating bumps and the second electrical wiring films 206. Then, as a result, stress concentratedly arise at the steps 212 of the protective films 207 arranged adjacent to the through-hole 200 so as to surround the through-hole 200 and hence a crack or cracks can most probably arise at the above-identified positions. When the applied pressure is raised in order to minimize the occurrence of trouble in the electric connection, such as peeling or breaking of the electrode leads 534, the resultant tendency will be that larger cracks can take place by a greater number in the protective films 207. When one or more than one crack arise at the steps 212 of the protective film 207, moisture, or liquid (e.g. ink) in particular, can get into the inside of the recording element substrate to consequently corrode the electrical wiring films 203 and 206 that are typically made of aluminum. In the process of preparing the liquid ejection head, a sealing agent is applied to the electric connections for the purpose of protecting the electric connections particularly between the plating bumps and the electrode leads 534. However, the moisture absorbed by the sealing agent can get into the inside by way of the crack or cracks produced there to give rise to corrosion of the electrical wiring films 203 and 206.

Figure 7A:
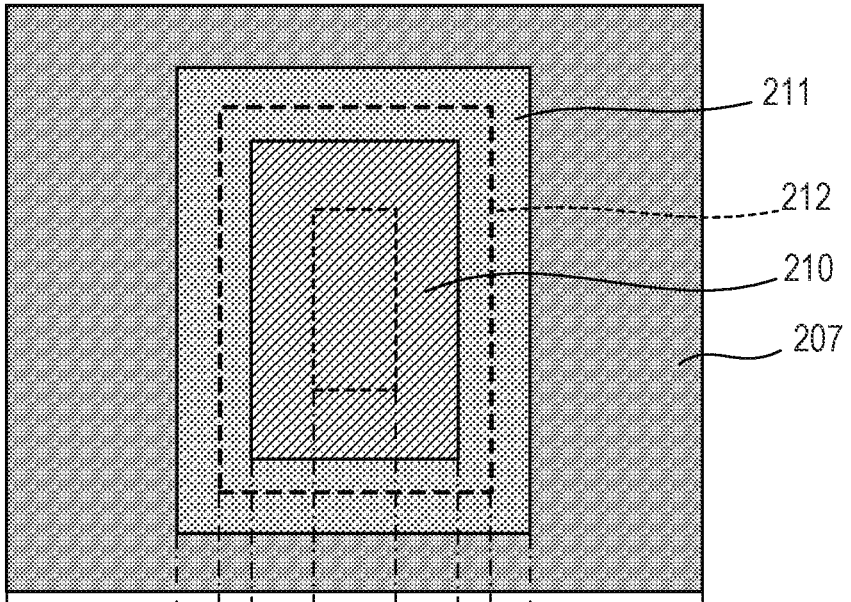
FIGS. 7A and 7B are a schematic illustration of a plating bump of an embodiment of liquid ejection head according to the present disclosure.
Figure 7B:
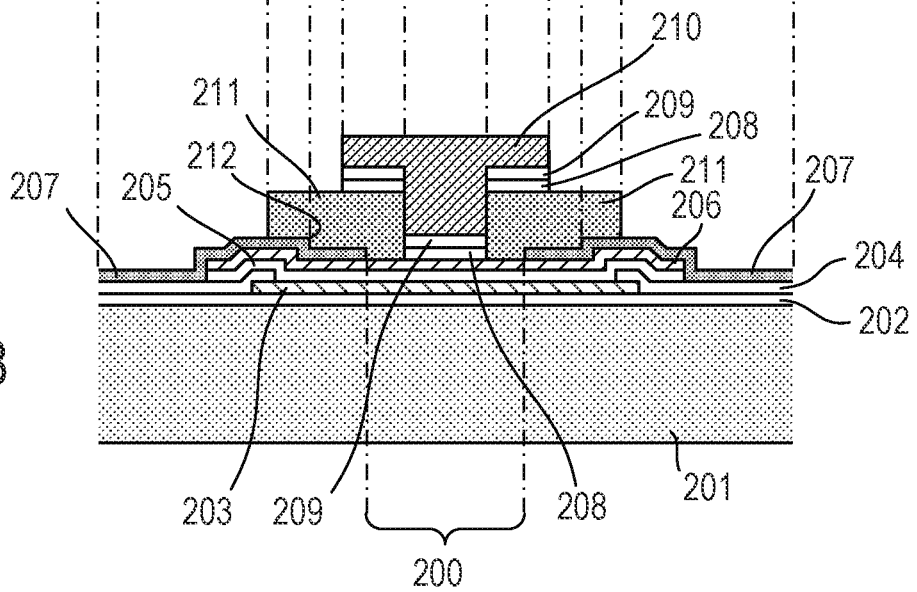

FIGS. 7A and 7B schematically illustrate the configuration of one of the plating bumps of an embodiment of the present disclosure. FIG. 7A is a schematic plan view of the part of the recording element substrate 601 where the plating bump is formed and FIG. 7B is a schematic cross-sectional view of the part shown in FIG. 7A. Like the one illustrated in FIGS. 6A and 6B, a heat storage layer 202, a first electrical wiring film 203, an interlayer installation film 204, a heating film 205, a second electrical wiring film 206 and a protective film 207 are sequentially formed on the entire area of one of the oppositely disposed surfaces of the silicon substrate 201. In the liquid ejection head of this embodiment again, openings are formed on the protective film 207 by way of a patterning process and through-holes 200 are formed to electrically connect an external circuit and the circuit wiring of the recording element substrate 601. At each of the through-holes 200, an adhesion improvement layer 208 is arranged on the second electrical wiring film 206 and a gold layer 209, which is a plating base layer, is formed on the adhesion improvement layer 208. The adhesion improvement layer 208 is typically formed by using TiW, which is a high melting point metal material. The adhesion improvement layer 208 operates to enhance the contact between the second electrical wiring film 206 and the gold layer 209 and it also operates as barrier metal for minimizing mutual diffusion of gold and aluminum. Unlike the ones shown in FIGS. 6A and 6B, the adhesion improvement layer 208 and the gold layer 209 are formed only in a substantially central area of each of the through-holes 200. In other words, those layers are not formed along the edge of each of the through-holes 200. A plating bump layer 210 is formed on the gold layer 209 by electroplating but the plating bump layer 210 shows a T-shaped cross section such that a part of the plating bump layer 210 is made to project toward above the protective film 207. The plating bump layer 210 and the protective film 207 are not held in tight contact with each other so as to produce a space between them. The space between the plating bump layer 210 and the protective film 207 is filled with a resin film 211 of an elastic resin material. Thus, the plating bump has a part projecting toward the upper surface of the resin film 211. The resin film 211 is formed such that it surrounds the pillar-like projecting part at the center of the T-shaped plating bump layer 210 and, at the same time, covers the step 212 of the protective film 207 arranged at the outside of the edge of the plating bump. The step 212 that is covered by the resin film 211 is the step located adjacent to the through-holes 200 so as to surround the through-hole 200 out of all the steps of the protective film 207.

In the instance of the known plating bump illustrated in FIGS. 6A and 6B, the step 212 of the protective film 207 arranged at the outside of the edge of the plating bump is exposed. With such an arrangement, one or more than one cracks can arise at the step 212 when the electrode lead is bonded to the plating bump by means of thermocompression bonding. To the contrary, with the plating bump of this embodiment, the step 212 is covered by an elastic resin film 211. Additionally, the plating bump has a part projecting beyond the upper surface of the resin film 211 of the plating bump. Thanks to the projecting part of the plating bump, the pressure applied from the bonding tool is absorbed by the elastic resin film 211 by way of the part of the plating bump that is projecting beyond the upper surface of the resin film 211. Due to the above-described arrangements, when pressure is applied to the plating bump from the bonding tool, the pressure applied to each of the electrical wiring films 203 and 206 can be reduced. Then, as a result, any possible deformation on the part of the first and second electrical wiring films 203 and 206 is minimized, the possible concentration of pressure at the step 212 of the protective film is avoided, and therefore the frequency of occurrence of a crack or cracks is minimized. Furthermore, if one or more than one cracks arise at the step 212 of the protective film 207, the risk that moisture gets into the side of the protective films 203 and 206 by way of such a crack or cracks to consequently corrode the wiring can be minimized because the step 212 is protected by the resin film 211.

Figure 8A:
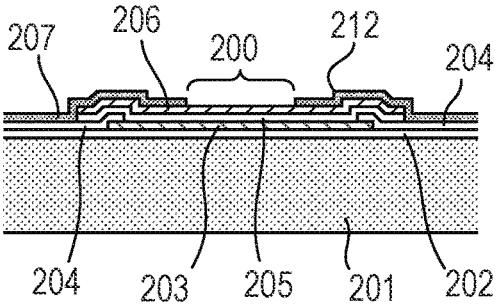
FIGS. 8A, 8B, 8C, 8D, 8E, 8F, 8G and 8H are schematic cross-sectional views of a liquid ejection head, showing the manufacturing steps of an embodiment of method of manufacturing a liquid ejection head according to the present disclosure.

In this embodiment, the plating bumps are formed by sequentially executing the steps S1 through S8, which will be described below. FIGS. 8A, 8B, 8C, 8D, 8E, 8F, 8G and 8H are schematic cross-sectional views of a plating bump, sequentially illustrating the process of forming the plating bump. Firstly, in Step S1, a semiconductor element (not shown) and other components necessary for driving an electrothermal converter, which is a recording element, are formed as a driver integrated circuit (IC) on one of the oppositely disposed surfaces of a silicon substrate 201 by way of the semiconductor manufacturing technology. Such a driver IC is typically formed as a multi-layered device of six layers or so by means of an IC manufacturing process. Then, a heat storage layer 202 of $SiO_2$ is formed on the above-identified surface of the silicon substrate 201 and a first electrical wiring film 203 of aluminum is formed on the heat storage layer 202. The first electrical wiring film 203 is a wiring film that operates as a common electrode to be used for the purpose of electric power supply or grounding when the driver IC drives the electrothermal transducer as a function of the drive signal applied to it. It is formed by means of a known patterning process. Then, an interlayer insulating film 204 of $SiO_2$ is formed to cover at least the top surface and the entire peripheral edge of the first electrical wiring film 203. Then, a heating film 205 for forming an electrothermal transducer is formed on the interlayer insulating film 204 and also a second electrical wiring film 206 of aluminum for supplying electric power is formed by directly laying it on the heating film 205. Both the heating film 205 and the second electrical wiring film 206 are formed by means of a patterning process. Then, a protective film 207 is formed by means of a relatively brittle material such as SiN or SiC for the purpose of protecting the electrical wiring films 203 and 206 and the heating film 205. The protective film 207 is subjected to a patterning process, involving the use of the photolithography technology, and a through-hole 200 is formed for the purpose of electrically connecting the second electrical wiring film 206 to an external circuit. The processes down to the formation of the through-hole 200 belongs to Step S1. Then, as a result, a complete recording element substrate 601 on which processes including the process of forming the through-hole 200 have been executed is produced as shown in FIG. 8A.

Figure 8B:
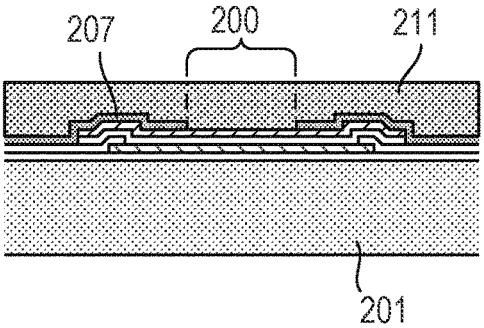
Figure 8C:
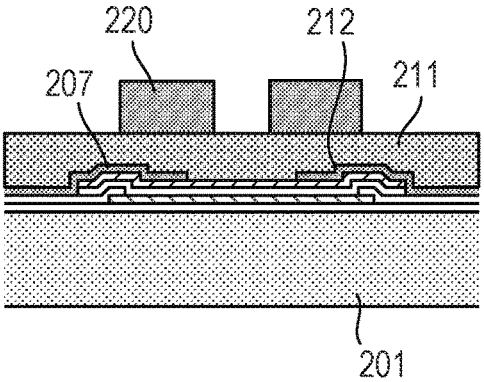
Figure 8D:
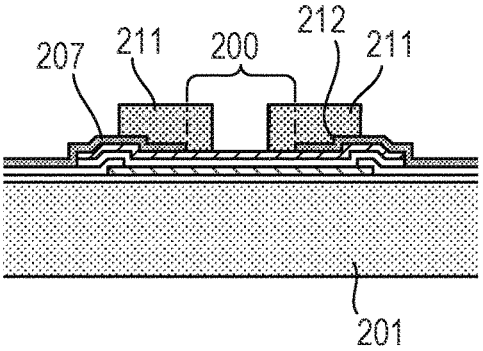

Then, in the next step, or Step S2, a resin film 211 is formed on the surface of the protective film 207 including the through-hole 200 by spin coating as shown in FIG. 8B and the resin film 211 is heated and cured. The resin film 211 is a film that keeps on being elastic after the heating and curing process. It can be prepared by using one or more than one material selected, for example, from a group of materials including polyether amide resin, acryl-based resin, cyclized rubber and epoxy resin. Subsequently, in Step S3, for example, negative type photoresist 220 is applied to the surface of the heated and cured resin film 211 by spin coating as shown in FIG. 8C and the applied photoresist is exposed to light and developed by means of the photolithography technique. In the exposure and development process, the photoresist 220 is made to remain in a region extending from a position located slightly in the inside from the end of the through-hole 200 to a position that allows the step 212 of the protective film 207 to be covered by the photoresist 220. Thereafter, in Step S4, a process of etching the resin film 211 is executed, using the photoresist 220 as mask. As a result, as shown in FIG. 8D, the resin film 211 is patterned so as to cover an area extending from a position located slightly in the inside from the end of the through-hole 200 to the step 212 of the protective film 207. At this time, in the inside of the through-hole 200, no resin film 211 is formed on the pillar-like part of the T-shaped plating bump layer 210 and hence the second electrical wiring film 206 is exposed on the above-identified part.

Figure 8E:
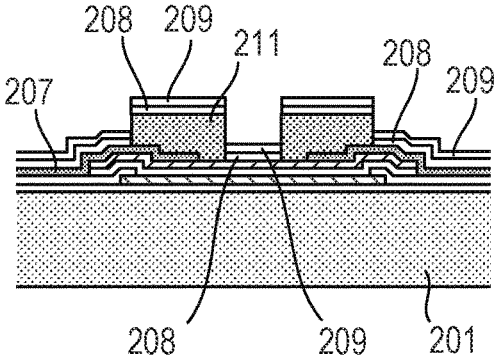
Figure 8F:
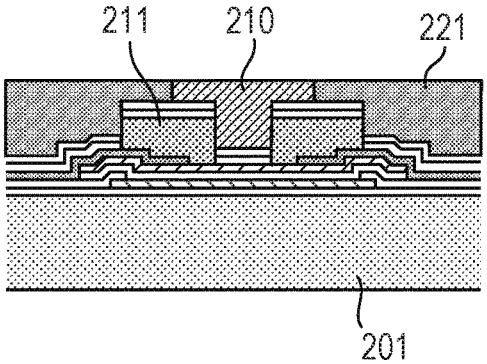

Then, in Step S5, an adhesion improvement layer 208 that is typically made of TiW is formed on the entire surface by means of a vacuum film forming apparatus or the like to a predetermined thickness and a gold layer 209 is formed on the entire surface also by means of a vacuum film forming apparatus or the like to a predetermined thickness as shown in FIG. 8E. Note that, in the area where the resin film 211 is formed, the adhesion improvement layer 208 and the gold layer 209 are formed on the front surface of the resin film 211, whereas, with regard to the remaining area, the adhesion improvement layer 208 and the gold layer 209 are formed on the second electrical wiring film 206 in the inside of the through-hole 200 but they are formed on the protective film 207 at the outside of the through-hole 200. After forming the gold layer 209, in Step S6, typically negative type photoresist 221 is applied by means of spin coating so as to make it lie on the gold layer 209 as a layer and the applied photoresist 221 is exposed to light and developed by means of the photolithography technique so as to remove the photoresist 221 to make it show the shape of the plating bump layer 210. Namely, the photoresist 221 is subjected to a patterning process so as to make it reflect the shape of the plating bump having the part projecting toward the upper surface of the resin film 211. Then, gold is deposited in the region having a T-shaped cross section produced as the photoresist 221 is removed as a result of executing an electroplating of causing an electric current of a predetermined level to flow, using the gold layer 209 as electrode. Thus, consequently, a plating bump layer 210 having a thickness sufficient for forming a bump is formed in the inside of the photoresist 221. FIG. 8F shows the produced plating bump layer 210.

Figure 8G:
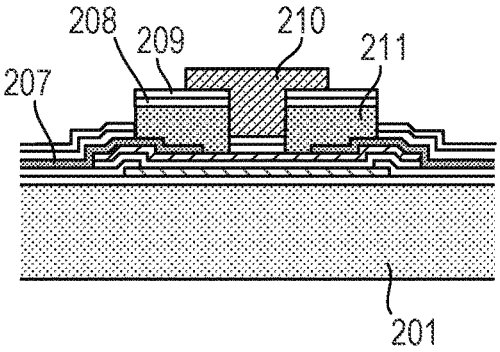
Figure 8H:
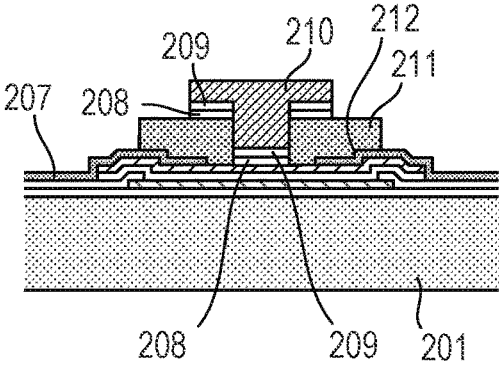

After the execution of the electroplating process, the photoresist 221 is removed by immersing the recording element substrate in a stripping solution for a predetermined period of time in Step S7 to expose the gold layer 209 as shown in FIG. 8G. Then, in Step S8, the gold layer 209 is removed by immersing the recording element substrate for a predetermined period of time in an etching solution of iodine and potassium iodide that additionally contains a nitrogen-based organic compound. Subsequently, the adhesion improvement layer 208 is removed by immersing the recording element substrate in an etching solution that contains hydrogen peroxide for a predetermined period of time. Plating bumps of gold are formed as electrode terminals 605 as a result of executing the above-identified processes. FIG. 8H shows a completed plating bump, which is identical with the one shown in FIG. 7B. Note that, in Step S8, the part of the gold layer 209 and that of the adhesion improvement layer 208 at the respective positions that are covered by the projecting part of the plating bump layer 210 located on the upper surface of the resin layer 211 are not removed because the plating bump itself operates as etching mask. Therefore, the part of the adhesion improvement layer 208 and that of the gold layer 209 located at those respective positions remain unremoved even in the completed plating bump. As a result of the executions of Steps S1 through S8, the resin film 211 having an elastic property is formed between the plating bump layer 210 and the protective film 207 so as to cover the step 212 of the protective film 207 extending from the end of the opening of the protective film 207 to the outside of the edge of the plating bump.

As described earlier by referring to FIG. 5, the electric connection areas of the recording element substrate 601 and the electrical wiring tape 531 are sealed by the first sealing agent 537 and the second sealing agent 538. The first sealing agent 537 mainly seals the rear surface side of the connection area of the electrode lead 534 and the electrode terminal 605 of the recording element substrate 601, and an outer peripheral portion of the recording element substrate 601, whereas the second sealing agent 538 seals the front surface side of the connection area. With regard to the arrangement of the electrode terminal 605, when the known arrangement is employed for the plating bump as shown in FIGS. 6A and 6B, the second sealing agent 538 is applied to the front surface of the protective film 207. To the contrary, with the arrangement of this embodiment, the second sealing agent 538 is applied to the front surface of the protective film 207 and that of the resin film 211. In the liquid state, the second sealing agent 538 flows less easily on the surface of the resin film 211 than on the surface of the protective film 207. Consequently, the electric reliability of the liquid ejection apparatus can be degraded due to an unsatisfactory level of protection of the electric connection area caused by the second sealing agent 538. Additionally, due to an increase in the height of the sealing member from the recording element substrate 601, a jam or some other trouble of recording mediums can easily arise in a recording process, using one or more than one recording medium, that takes place after fitting a liquid ejection head 501 to a liquid ejection apparatus. For the purpose of minimizing the frequency of occurrence of such trouble, the area where the resin film 211 is formed on the front surface of the recording element substrate 601 is desirably limited.

In the instance illustrated in FIGS. 7A and 7B, the resin film 211 is formed to extend from the end of the opening of the protective film 207 to a position that allows the resin film 211 to cover the entire area of the step 212 of the protective film 207. However, the arrangement of the resin film 211 is by no means limited to the above-described one. For example, part of the step 212 of the protective film 207 may not necessarily be covered by the resin film 211. FIGS. 9AA and 9AB, FIGS. 9BA and 9BB and FIGS. 9CA and 9CB are schematic plan views and schematic cross-sectional views of three other exemplary resin film 211 forming regions of recording element substrate 601 that can be used for the purpose of the present disclosure. An electrode lead 534 is already crimped to the illustrated plating bump of each of the drawings, although only the contour of the electrode lead is shown in each of the plan views. The region 213 in each of the plan views is the region of the electrode lead 534 that is to be pressed by the bonding tool when the electrode lead 534 is thermally crimped to the metal bump by gang bonding. As shown in FIGS. 9AA and 9AB or FIGS. 9BA and 9BB, the resin film 211 may be formed so as to show a U-shaped profile. Alternatively, as shown in FIGS. 9CA and 9CB, the step 212 may be formed so as to be covered by the resin film 211 in a region located close to the region 213 that is pressed by the bonding tool in the bonding process.

In the liquid ejection head shown in FIG. 4, the ejection orifice forming member 609 where the flow path wall 606 and the ejection orifice 607 are formed is aligned on and bonded to the recording element substrate 601. To improve the adhesion of these members at the time of the bonding process, an adhesion improvement layer that is different from the adhesion improvement layer 208 employed for forming the plating bump may sometime be arranged on the recording element substrate 601. Then, the resin film 211 may be made to also operate as such an adhesion improvement layer to give rise to an adhesion improving effect. In other words, an adhesion improvement layer to be used for the ejection orifice forming member 609 may be formed in a region extending from the end of the opening of the protective film 207 onto the step 212 of the protective film 207. With such an arrangement, then, an increase in the number of manufacturing steps required to arrange an additional resin film 211 for the purpose of minimizing the risk of producing one or more than one crack in the step 212 of the protective film 207 can effectively be avoided.

With the above-described embodiment of the present disclosure, if pressure is applied to the plating bumps during the bonding process, the pressure applied to the base layer side can be minimized by the elastic resin film 211 arranged between the plating bump layer 210 and the protective film 207. Then, as a result, the first and second electrical wiring films 203 and 206 are protected against deformation and concentration of stress at the step 212 of the protective film 207 is minimized to consequently and effectively avoid an occurrence of trouble such as an occurrence of one or more than one cracks. While gang bonding is employed for the operation of bonding the electrode lead 534 in the above description of this embodiment, it may be clear that the present disclosure is equally effective for execution of single bonding. Furthermore, while the plating bumps are formed by using gold in the above description, the plating bumps may alternatively be formed by using a metal material other than gold.

This disclosure is equally effectively applicable to a liquid ejection head manufacturing process where the step of electrically connecting the recording element substrate 601 and the electrical wiring tape 531 is executed in an early manufacturing stage. This disclosure is also applicable to a liquid ejection head manufacturing process where the recording element substrate 601 and the electrical wiring tape 531 are solely and rigidly fitted to the base member (not shown) of the liquid ejection head in advance and thereafter they are electrically connected to each other.

The present disclosure is applied to a color liquid ejection head 501 that ejects inks of three different colors of cyan, magenta and yellow in the above-described instance. However, it will be understood without any issue that the present disclosure is equally applicable to a liquid ejection head 500 for black ink. It will equally and clearly be understood that the number of colors and that of densities (color tones) can freely and appropriately be selected. Additionally, the ink storage section is inseparably integrated to the liquid ejection head in the above-described embodiment. However, from the viewpoint of minimizing the load applied to the electrode terminal 605 and the protective film 207, the present disclosure is also applicable to a liquid ejection head where the ink storage tank is separably integrated to it or a liquid ejection head that is separated from the ink tank.

Thus, the present disclosure provides a liquid ejection head in which plating bumps are employed for electric connections and the damage that can arise to the protective film at the time of crimping the electrode lead to each of the plating bumps can be minimized. The present disclosure also provides a method of manufacturing such a liquid ejection head.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2020-205129, filed Dec. 10, 2020, which is hereby incorporated by reference herein in its entirety.

What is claimed is:

1. A liquid ejection head including a recording element substrate, the recording element substrate comprising:

a recording element to be driven to eject liquid;

a circuit wiring for supplying energy for driving the recording element;

a protective film for covering the circuit wiring to protect the circuit wiring against the liquid;

an electrode area exposed through an opening arranged in the protective film to electrically connect the circuit wiring to an external circuit, wherein the protective film covers the circuit wiring in an outer adjacent region to the opening to define a step in the protective film;

a plating bump made of a metal material and arranged on the electrode area so as to be electrically connected to the electrode area;

a resin film that has elastic properties and is formed to cover the step and to extend from an inner peripheral region of the opening onto the protective film beyond an edge of the opening; and an electrode lead electrically connected with the plating bump, wherein the plating bump includes a part projecting from a top of the electrode area onto an upper surface of the resin film, and wherein the resin film is located between the plating bump and the protective film along a direction perpendicular to a plane of the electrical connection between the plating bump and the electrode lead.

2. The liquid ejection head according to claim 1, further comprising a plating base layer arranged between the electrode area and the plating bump so as to be employed as electrode in an electroplating process.

3. The liquid ejection head according to claim 1, wherein the resin film is arranged adjacently relative to and surrounds the electrode area so as to cover entirely the step.

4. The liquid ejection head according to claim 1, wherein the resin film is arranged adjacently relative to and surrounds the electrode area so as to cover partially the step.

5. The liquid ejection head according to claim 1, wherein the resin film is made of a material or more than one materials selected from a group of materials including: polyether amide resin, acryl-based resin, cyclized rubber, and epoxy resin.

6. The liquid ejection head according to claim 1, further comprising an ejection orifice forming member having an ejection orifice for liquid, wherein the recording element substrate and the ejection orifice forming member are bonded to each other, and wherein the resin film operates as an adhesion improvement layer between the recording element substrate and the ejection orifice forming member.

7. The liquid ejection head according to claim 1, wherein the recording element is an electrothermal transducer driven by an electric signal to give rise to film boiling in the liquid.

* * * * *